United States Patent [19]

Sugiyama et al.

[11] Patent Number: 4,887,511

[45] Date of Patent: Dec. 19, 1989

[54] HYDRAULIC CONTROL VALVE APPARATUS

[75] Inventors: Tsutomu Sugiyama; Toshiaki Yoshizumi, both of Amagasaki, Japan

[73] Assignee: Mitsubishi Denki Kabushiki Kaisha, Japan

[21] Appl. No.: 195,398

[22] Filed: May 12, 1988

Related U.S. Application Data

[63] Continuation of Ser. No. 863,730, May 16, 1986, abandoned.

[51] Int. Cl.[4] ..... F15B 13/16

[52] U.S. Cl. ..... 91/361; 91/405; 91/459; 361/116

[58] Field of Search ..... 91/459, 361, 405, 417 R; 361/116, 79

[56] References Cited

U.S. PATENT DOCUMENTS

| | | | |
|---|---|---|---|
| 2,974,643 | 3/1961 | Gillham et al. | 91/405 |
| 3,386,339 | 6/1968 | Selsam | 91/417 R X |
| 3,492,922 | 2/1970 | Van Sickle | 91/361 X |
| 3,555,354 | 1/1971 | Kotos | 361/116 X |
| 3,700,396 | 10/1972 | Adams | 91/459 X |
| 3,946,284 | 3/1976 | Dieringer | 91/459 X |
| 4,175,589 | 11/1979 | Nakamura et al. | 137/625.64 |
| 4,381,699 | 5/1983 | Häussler | 91/459 X |
| 4,464,978 | 8/1984 | Ichiryu et al. | 91/459 |
| 4,595,979 | 6/1980 | Arai et al. | 91/361 X |

FOREIGN PATENT DOCUMENTS 57-45137 3/1982 Japan .

*Primary Examiner*—William E. Wayner

*Attorney, Agent, or Firm*—Leydig, Voit & Mayer

[57] ABSTRACT

A hydraulic operating apparatus for a circuit interrupter comprises a conversion unit for converting input information from the exterior concerning a speed control pattern into an electrical signal for driving a linear or servo motor according to the closing and interrupting commands, the motor drive signal provided from the converting means being transmitted to the motor such that the displacement of the motor causes the hydraulic control valve apparatus to be operated to switch the fluid passages to selectively drive the hydraulic cylinder in different directions, and that the position during the switching of the hydraulic control valve driven by the motor is made different from the final stop position at its interruption or closed state to provide a throttle effect of a throttle in the hydraulic control valve thereby controlling the speed of the hydraulic cylinder. The hydraulic operating apparatus may comprise a conversion unit for converting contact closing and opening commands into an electrical signal for driving a linear or servo motor.

7 Claims, 15 Drawing Sheets

CLOSED

OPENING

END OF OPENING

OPENED

CLOSING

END OF CLOSING

CLOSED

OPENED

OPENING

CLOSING

OPENING

CLOSING

HYDRAULIC CONTROL VALVE APPARATUS

This application is a continuation division of application Ser. No. 863,730, filed May 16, 1986 now abandoned.

BACKGROUND OF THE INVENTION

This invention relates to a hydraulic control valve apparatus and particularly to a drive mechanism for a valve of a hydraulic control valve apparatus.

A typical hydraulic control valve apparatus in which the switching of the fluid is achieved by an electrical signal is arranged, as shown in FIG. 1, such that the electrical signal is applied to a coil C of an electromagnetic solenoid ES comprising a plunger P, the coil C, a yoke Y and a return spring RS to obtain a displacement which is utilized to operate a valve V, thereby achieving the switching of the hydraulic fluid.

In the hydraulic control valve apparatus employing an electromagnetic solenoid as a drive unit, the electromagnetic solenoid has a clearance or gap of distance L between one end of the plunger P and one end of the yoke Y. The gap distance L is normally maintained by the return spring RS. When the coil C is excited by an electrical signal, the plunger P is magnetically driven to apply its force F to the valve V, thereby to achieve the valve operation. Since the driving force F of the electromagnetic solenoid ES decreases in inverse proportion to the second power of the gap distance L, the initial driving force for of the electromagnetic solenoid must be larger than the operating load f1 of the valve V. Therefore, at the time of stopping of the actuation of the plunger, a heavy impact due to an excessive force f2 shown in the FIG. 2 is experienced, resulting in decrease in the durability of the electromagnetic solenoid which disadvantageously decreases operational reliability.

Also, since the drive force F is inversely proportional to the second power of the gap distance L as seen from the characteristic curve shown in FIG. 2, when the operating stroke and required drive power of the valve are great, it has been necessary either to make the electromagnetic solenoid larger or to provide a levering mechanism or the like for increasing the plunger displacement. This has been disadvantageous in that the structure of the hydraulic control valve apparatus becomes complicated and response is degraded.

Puffer-type circuit interrupters have been widely used in which an $SF_6$ gas having good electrically insulating and current interrupting capabilities is used as an arc extinguishing medium whereby the high pressure $SF_6$ gas compressed within a puffer chamber is blasted into an electric arc to extinguish.

Most of the operating mechanism for use in puffer-type circuit interrupters of 300 KV or 500 KV class are of the hydraulic operating type, which can realize high speed interruption within 2 cycles because of the large operating force available, improving the interrupting capability.

The hydraulic operating system uses a fluid at a higher pressure than that in a compressed air operating system, so that the operating mechanism can be made compact and inexpensive. However, as the circuit interrupter becomes higher in operating speed, the hydraulic operating mechanisms and the control units therefor such as the electromagnetic switching valve inevitably also become large. Electromagnetic switching valves generally used are electromagnetic repulsive control valves, which naturally must be made large if a great force is to be provided.

Recently, as circuit interrupters come to have higher speeds and improved interrupting capability, free speed control and stopping with reduced shock to the drive unit are being considered more important. For example, as apparent from the travel curve (stroke-time curve) of a circuit interrupter shown in FIG. 7, the travel curve without speed control (shown by a broken line) during the operation of the puffer-type circuit interrupter is distorted and disadvantageously affects the interrupting capability of the interrupter.

In the conventional systems in which the previously mentioned electromagnetic repulsive control valve is used, the stop position of the drive unit cannot be controlled, so that the speed of the drive unit must be controlled by configuring the diameter of the contraction valve to a predetermined dimension. Therefore, changing the speed pattern during the design of the interrupter and the operating mechanism is difficult, posing a difficult problem to be solved.

Also, in order to solve the problems involved in a high speed circuit interrupter and to answer the demand for improved interrupting performance, a suitable interrupting speed must be selected in accordance with the voltage and the current conditions of the lines to be protected at the time of interruption, and in order to improve the reliability of the circuit interrupter, the massive stress often exerted on the drive of the circuit interrupter should be reduced. Further, the range of interruption conditions which can be covered by the circuit interrupter can be increased by selecting an interrupting speed with the parameters determining the interrupting duty, such as the current to be interrupted, taken into consideration and by changing the speed pattern during the interrupting operation, whereby the interrupting capability of the circuit interrupter is improved. It is therefore desirable to provide an arrangement in which the speed control of the circuit interrupter can be achieved on an on-line basis.

SUMMARY OF THE INVENTION

Accordingly, an object of the present invention is to provide a hydraulic control valve apparatus in which the above discussed problems are eliminated.

Another object of the present invention is to provide a hydraulic control valve apparatus which is reliable, simple in structure and has a good response.

Still another object of the present invention is to provide a hydraulic control valve apparatus for a circuit interrupter wherein a linear motor having a large output power as compared with an electromagnetic repulsive control valve or the like is provided and which has a very high response speed of 2–3 ms at startup.

The hydraulic control valve apparatus of the present invention is constructed such that the valve is actuated by the driving of a linear motor.

According to the present invention, good response is obtained with a simple structure since the control of the stroke is easy and a linear motor of a large driving force is used.

According to the present invention a hydraulic control valve apparatus for a circuit interrupter is provided in which a linear motor having a large output power as compared with an electromagnetic repulsive control valve or the like is utilized and which further has a very high response speed of 2–3 ms at startup.

The hydraulic operating apparatus for a circuit interrupter is provided with a signal edit and conversion unit which allows the pattern of the speed control of the linear motor to be easily modified from the exterior of the operating mechanism to control the driving of the linear motor, whereby the main hydraulic control valve is driven by the linear motor not through an amplifying valve, whereby the pattern of the speed control of the circuit interrupter can be freely varied and set from the exterior of the hydraulic operating mechanism. With this arrangement, the modification of the speed pattern of the circuit interrupter and the operating mechanism during their design can be made very easily.

The hydraulic operating apparatus for a circuit interrupter may utilize a servo motor, so that the main hydraulic control valve is driven and operated without using an amplifying valve and the speed control of the circuit interrupter or the like can freely be achieved.

The hydraulic operating apparatus for a circuit interrupter may be provided with a signal edit and conversion unit which allows the pattern of the speed control of the servo motor to be easily modified from the exterior of the operating mechanism to control the driving of the servo motor, whereby the main hydraulic control valve is driven by the servo motor without through the use of an amplifying valve, whereby the pattern of the speed control of the circuit interrupter can be freely varied and set from the exterior of the hydraulic operating mechanism. With this arrangement, the modification of the speed pattern of the circuit interrupter and the operating mechanism during their design can be made very easily.

DESCRIPTION OF THE PREFERRED EMBODIMENTS

Figure 1:
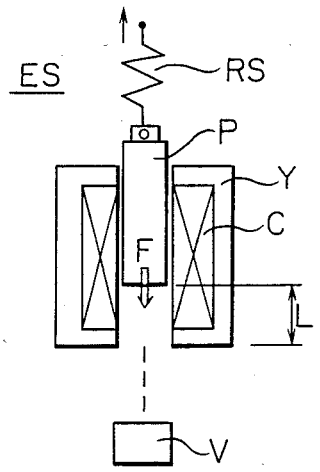
FIG. 1 PRIOR ART
FIG. 1 is an explanatory view of the conventional hydraulic control valve.
Figure 2:
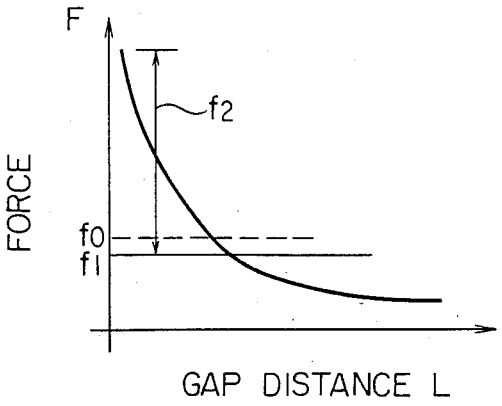
FIG. 2 PRIOR ART
FIG. 2 is an output characteristic chart of the electromagnetic solenoid.
Figure 3:
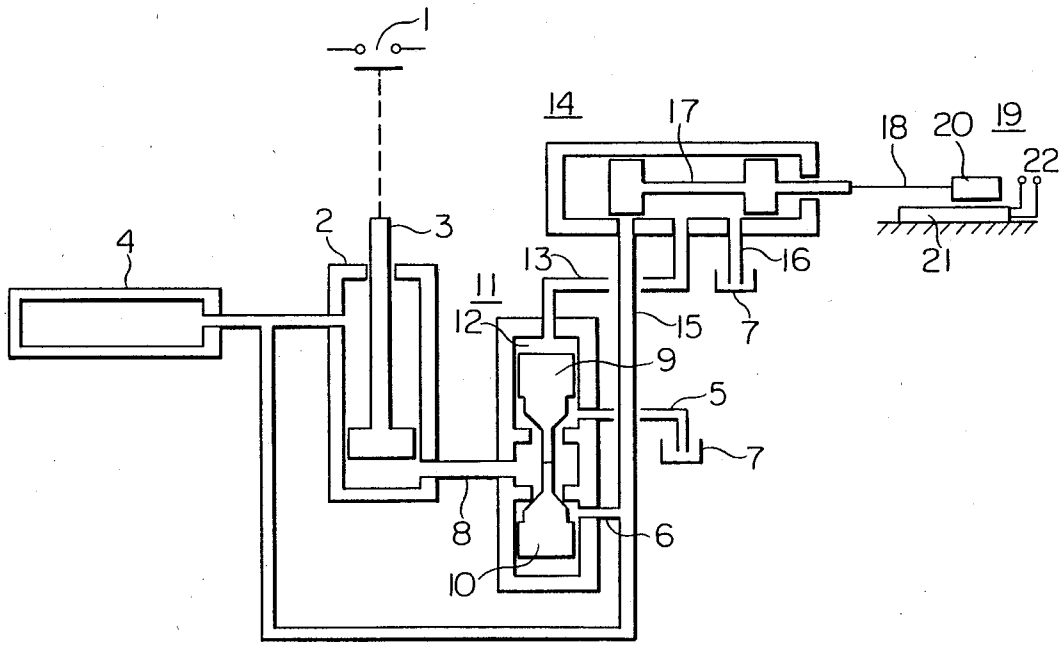
FIG. 3 is a system line diagram illustrating one embodiment of the present invention as applied to the hydraulic operating mechanism for circuit interrupters in the open state.
Figure 4:
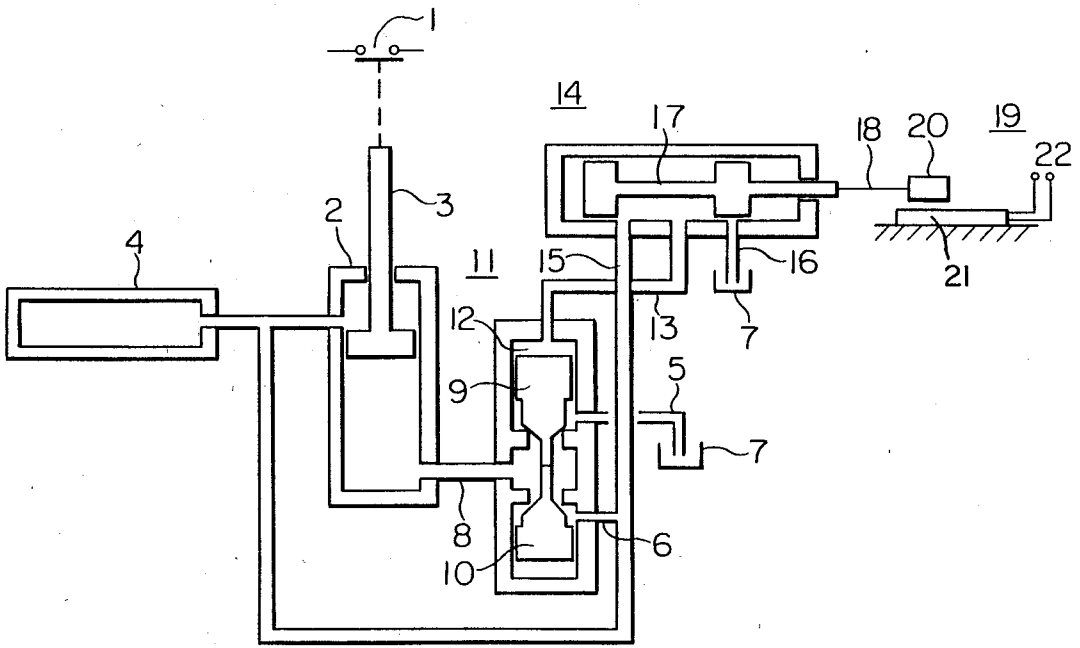
FIG. 4 is a system line diagram similar to FIG. 3 but illustrating in the closed state.

One embodiment of the hydraulic control valve apparatus of the present invention as applied to a hydraulic operating system for a circuit interrupter is illustrated in FIGS. 3 and 4. FIG. 3 is a view showing the interruption state of the interrupter, and FIG. 4 is a view showing the closed state. In these figures, the interrupter contact 1 is mechanically connected to a differential piston 3 of a hydraulic cylinder 2 and is closed and interrupted in response to the operation of the differential piston 3. The hydraulic cylinder 2 is connected at its small piston face side (rod side) to an accumulator 4 which is always maintained at a high pressure. On the other hand, the large piston face side (head side) is connected to a switch valve 11 including an oil exhaust valve 9 and an oil supply valve 10 through a conduit 8 so that it is freely communicated to a low pressure tank 7 or the accumulator 4 through conduits 5 or 6. Also, a pilot portion 12 of the oil exhaust valve 9 is connected to a hydraulic control valve 14 through a conduit 13, and this hydraulic control valve 14 is provided with a conduit 15 connected to the accumulator 4 and a conduit 16 connected to the low pressure tank 7 in addition to the conduit 13, so that the pressure in the pilot portion 12 of the fluid exhaust valve 9 can be changed in accordance with the position of a spool 17 constituting the fluid exhaust valve 9. The positional control of the spool 17 is achieved by a linear motor 19 connected to a rod 18 at one end. This linear motor 19 comprises a permanent magnet 20, a coil 21 and power source terminals 22 for inputting therein an electrical signal for closing or interrupting.

The operation of the hydraulic operating mechanism for a circuit interrupter of the above structure will now be described.

When it is desired to close the mechanism from the state shown in FIG. 3 to the state shown in FIG. 4, a closing signal is supplied to the power source terminals 22 of the linear motor 19 to move the permanent magnet 20 which is the movable part to the left in the figure. Therefore, the spool 17 of the hydraulic control valve 14 is moved to the left by the rod 18 to close the conduit 16 connected to the low pressure tank 7 and open the conduit 15 connected to the accumulator 4. Therefore, the conduit 13 is supplied with a high pressure fluid and the pilot portion 12 of the fluid exhaust valve 9 also becomes pressurized. Therefore, the fluid exhaust valve 9 closes the circuit connected to the low pressure tank 7 through the conduit 5 and opens the fluid supply valve 10 to communicate the conduit 6 connected to the accumulator 4 to the conduit 8 connecting the switch valve 11 and the hydraulic cylinder 2. Therefore, the high pressure fluid from the accumulator 4 is supplied to the large piston face head side of the differential piston 3 through the conduit 6 and the conduit 8 to drive the differential piston upward to close the contact 1, thereby completing the closing operation (The state shown in FIG. 3).

When it is desired to interrupt the apparatus from the state shown in FIG. 4 to the state shown in FIG. 3, an interrupting signal is supplied to the linear motor 19 via the power source terminals 22. The permanent magnet 20 is then driven to the right in the figure to move the spool 17 of the hydraulic control valve 14, causing the conduit 15 to close and causing the conduit 16 to open, whereby the high pressure fluid is exhausted from the pilot portion 12 of the fluid exhaust valve 9 to the low pressure tank 7 through the conduit 13 and the conduit 16. Therefore, the fluid exhaust valve 9 opens the conduit 5 and the fluid supply valve 10 closes the conduit 6 to exhaust the high pressure fluid from the large piston face (head side) of the differential piston 3 to the low pressure tank 7 through the conduit 8, the fluid exhaust valve 9 and the conduit 5, causing the differential piston 3 to move downward and causing the contact 1 to open, thereby completing the interrupting operation (The state shown in FIG. 3).

When the hydraulic control valve driven by the linear motor of the present invention is utilized in the control unit for providing contact closing and interrupting commands in the hydraulic operating mechanism for a circuit interrupter constructed as described above, the change in driving force of the control valve with respect to the change in the stroke of the valve is smaller as compared to the conventional design in which an electromagnetic solenoid is used. Therefore, the need for excessive force relative to the operating load of the hydraulic control valve is eliminated and the impact force generated upon the termination of the action can be reduced. Therefore, a hydraulic control valve apparatus can be constructed which is stable and reliable in operation, and the overall system reliability of the hydraulic operating mechanism for circuit interrupters can be improved.

Also, since the driving stroke of linear motors can be made very long in comparison with those of electromagnetic solenoids and the piezoelectric elements which are recently being investigated for possible applications in control, the linear motor can directly drive the control valve without the need for a conversion mechanism such as a leverage device even when the operation stroke of the hydraulic control valve is long. Therefore, the hydraulic control valve can be simple in structure and yet very responsive, so that such a hydraulic control valve is suitable for use in a hydraulic operating mechanism for circuit interrupters in which high speed operation is required.

While the present invention has been described in terms of the embodiment in which the hydraulic control valve driven by the linear motor is applied to the hydraulic operating mechanism for circuit interrupters, when a hydraulic control valve requiring a large driving force is to be driven by a small linear motor, the driving of the hydraulic control valve may be achieved through a mechanical amplifying means such as a leverage device, which is advantageous from the point of view of miniaturization and is within the scope of the present invention.

As has been described above, according to the present invention, it is possible to provide a reliable and responsive hydraulic control valve apparatus by utilizing a linear motor as a drive unit for the hydraulic control valve.

The present invention will now be described in terms of one embodiment shown in FIG. 5. Reference numeral 101 designates an interrupting contact, 102 is a hydraulic cylinder for closing and opening the contact 101, 103 is a main control valve controlled by a linear motor 104. The linear motor 104 is constructed from a permanent magnet 105 and a coil 106, the permanent magnet 105 being movable in the longitudinal direction of the coil 106. One end of the permanent magnet 105 is connected to a spool 107 which together with valve casing 108 housing the spool 107 constitutes the main control valve 103.

The valve casing 108 has formed therein a port 112 opening in the reduced diameter portion at the central portion of the spool 107 and connected to a conduit 109, a port 113 connected to a hydraulic fluid side conduit 110 connectable to the conduit 119 by the spool land, and a port 114 to which an exhaust fluid side conduit 111 connectable to the conduit 109 by the spool land is connected. Exhaust fluid drain ports 115 and 116 are also provided. The hydraulic cylinder 102 comprises a cylinder 117, a piston 118 and a rod 119, and the hydraulic cylinder 117 has connected thereto the conduits 109 and 120 which respectively supply the fluid for contact closing from the piston head side and the fluid for contact opening from the rod side. Low pressure tanks **123*a*, 123*b* and 123*c* for storing the return fluid are also provided. An accumulator 121 normally supplemented by an unillustrated pump always stores a high pressure fluid. An edit and conversion unit 130 is provided for editing and converting a control current signal which excites the stationary coil 106 of the linear motor 104 in response to the set input previously given from the exterior. The permanent magnet 105 of the linear motor 104 repeats the movement and the stop to predetermined positions at high speed by the energization and deenergization of the coil 106 by the signal current. A set input unit 131 such as a keyboard type operating desk for data input is provided for presetting and inputting the speed pattern of the circuit interrupter into the edit and conversion unit 130**.

When it is desired to close the contact 101 of the circuit interrupter as shown in the figure, the closing operation command supplied to the circuit interrupter is transmitted to the linear motor 104 as a series of drive signal currents through the conversion unit 130. The linear motor repeats a number of movements and stops in accordance with the preset pattern supplied from the speed pattern setting and inputting unit 131 and switches the main control valve 103 into the illustrated position.

While the high pressure fluid is supplied to the rod side of the piston through the conduit 120 upon the closing and opening operations, the above switching of the main control valve 103 causes the conduits 110 and 109 to be brought into communication through the ports 113 and 112 and the head side of the piston is also provided with a high pressure fluid, so that the piston is driven to the left to close the contact 101 of the circuit interrupter.

When an interrupting operation command is provided, a series of drive signal currents are transmitted to the linear motor from the conversion unit 130 to switch the main control valve 103 in the opposite position.

This results in the communication of the conduits 109 and 111 through the ports 112 and 114, causing the pressurized fluid on the cylinder head side to be exhausted, whereby the contact 101 of the circuit interrupter is opened by the pressure differential between the rod side and the head side.

Figures 6A, 6B, 6C, 6D, 6E, 6F:
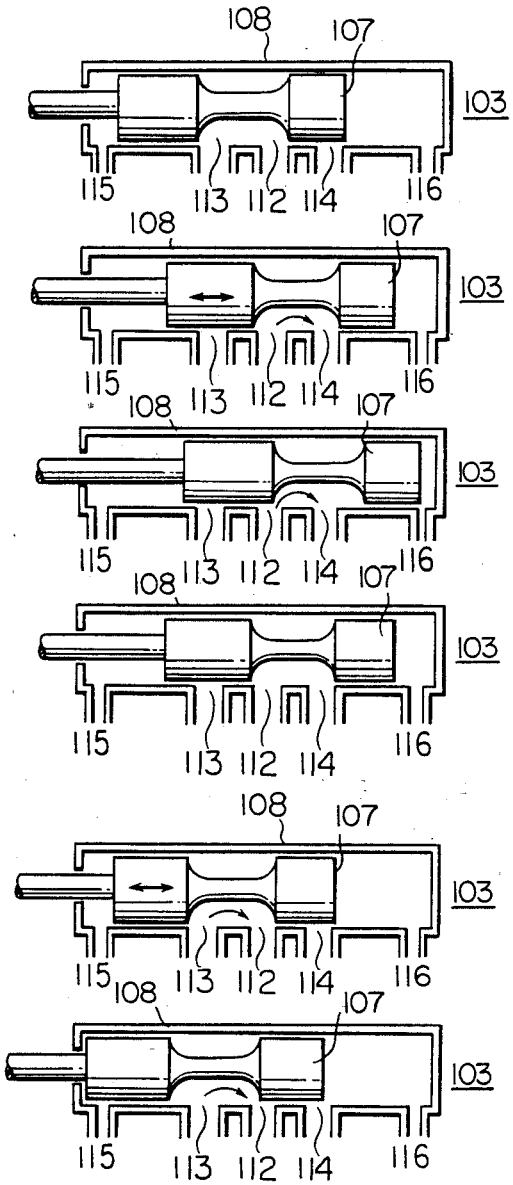
FIG. 6 is an explanatory view illustrating the operation of the main control valve of FIG. 5.

The control of speed will now be described in connection with FIG. 6. Positions (a)-(b)-(c)-(d) and (d)-(e)-(f)-(a) show the change in the position of the spool 107 within the main control valve 103 during the shift from the closed state to the open state and from the open state to the closed state, respectively.

Figure 7:
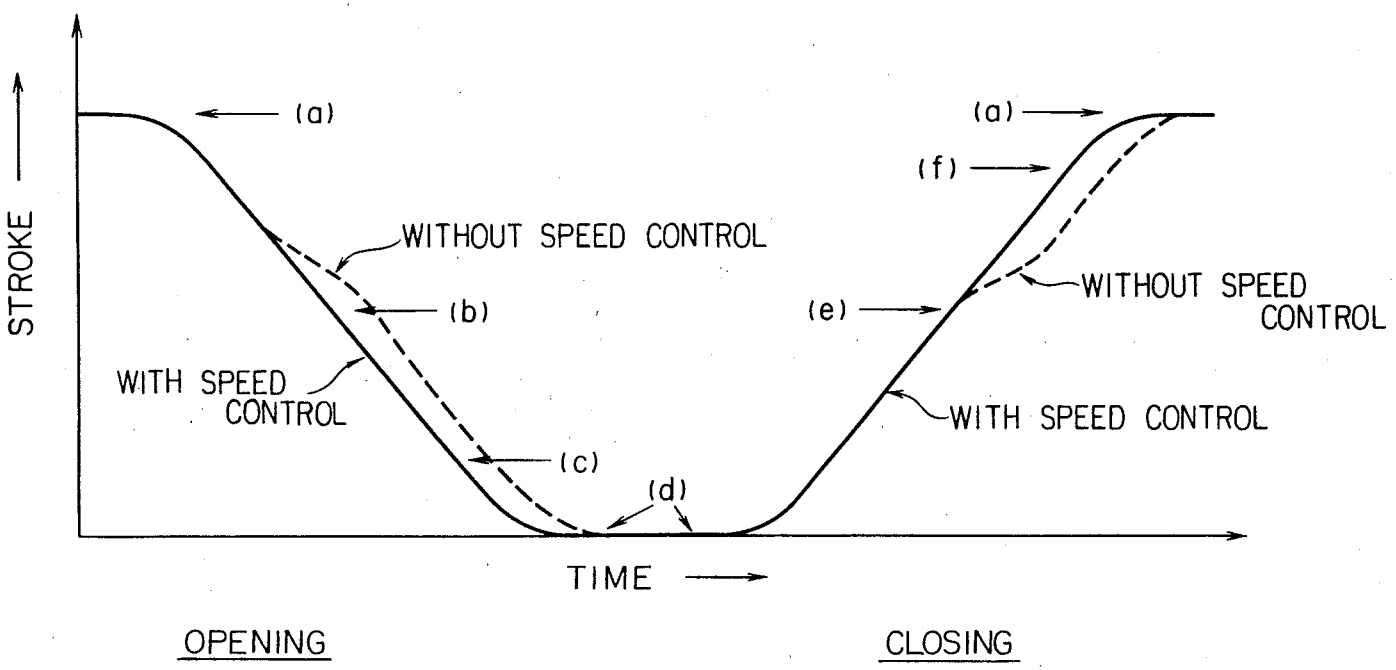
FIG. 7 shows the travel curve of the circuit interrupter.

These positions of the spool correspond to the reference characters (a)–(f) shown in the travel curve (stroke-time curve) represented by the solid line in FIG. 7, which shows the position of the piston 118 and therefore the contact 101 as a function of time.

The spool 107 which stays on the left in the figure during the closed state shown by (a) is driven to the right in the figure by an interrupter operating command until the spool 107 reaches about the position (b) during the period of time in which the load of a puffer cylinder of the circuit interrupter is large and the interrupting speed must be at its maximum. As the load of the puffer cylinder decreases the force needed for maintaining the same speed of the piston 118, the spool 107 is moved further rightward to reduce the cross sectional area of the port 112 and to increase the exhaust pressure on the cylinder head side, thus decreasing the net hydraulic force pushing the piston 118 to the right in FIG. 5.

At the final stage of the interruption, the spool 107 is further moved to the right as shown by (c) to close the port 112 almost completely, thereby further decreasing the net hydraulic force pushing the piston 118 to the right and increasing the damping effect by the meter-out control to achieve a smooth stop with relatively little shock.

When the piston 118 is to be stopped in the open state after the interruption has been completed, the spool 107 is returned back to the left as shown by (d) to fully maintain the communication between the ports 112 and 114.

When closing, the spool 107 is moved to the left as shown by (e) to bring the port 113 into communication with the port 112. This causes the hydraulic cylinder 102 to become a differential circuit. Speed control, however, is achieved by moving the spool 107 to the left as in the case of interruption.

Figure 5:
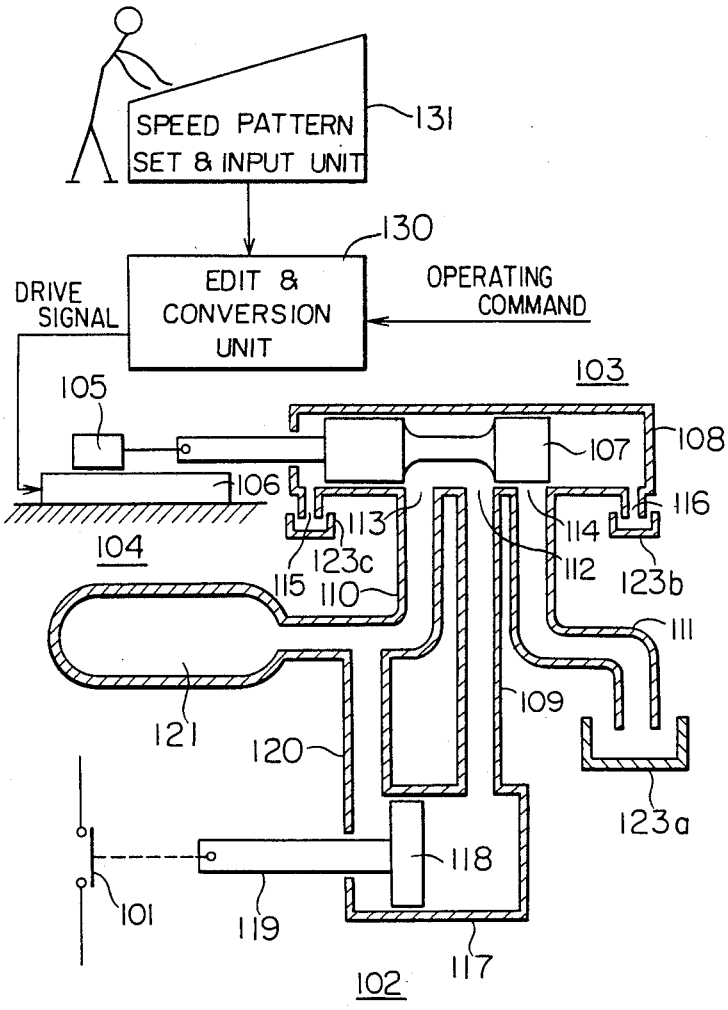
FIG. 5 is a schematic diagram illustrating another embodiment of the hydraulic operating mechanism for a circuit interrupter of the present invention.

At the final stage of the closing operation, the spool 107 is further moved to the left to almost completely close the port 112, thereby decreasing the net hydraulic force pushing the piston 118 to the left in FIG. 5 and increasing the damping effect by the meter-in control to achieve a smooth stop with little shock.

With such an arrangement, the need for an amplifying valve or a damping dash pot, which are needed when an electromagnetic repulsive control valve is employed, are eliminated, providing a simplified and more compact operating mechanism.

Figure 8:
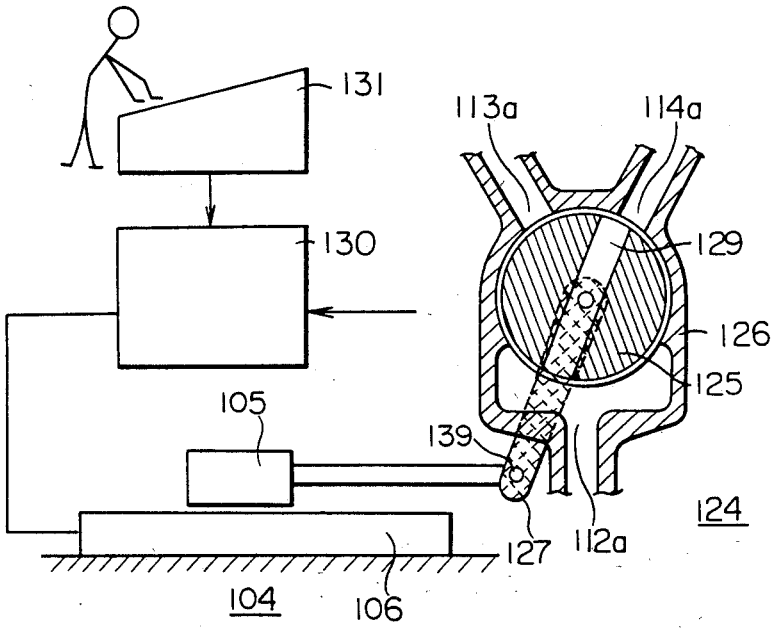
FIG. 8 is a schematic diagram illustrating another embodiment of the hydraulic operating mechanism of a circuit interrupter of the present invention.

FIG. 8 illustrates a portion of another embodiment of the present invention in which a rotary main control valve is used. In the figure, the rotary main valve 124 comprises a rotary valve 125 having a communicating bore 129 therein and a valve casing 126 for rotatably housing the rotary valve 125 therein.

One end of a lever 127 is secured to the rotary valve 125 and the other end is rotatably connected to the permanent magnet 105 of the linear motor by a pin 139.

The valve casing 126 has formed therein ports 112*a*, 113*a* and 114*a* which correspond in function to the ports 112, 113 and 114 formed in the valve casing 108 of the previously described linear main control valve.

As apparent from the drawings, as the linear motor 104 makes a linear motion in response to an operating command, the rotary main control valve is rotated and controls the speed of movement by decreasing the cross sectional area of the fluid passage between the bore 129 and the port 113*a* or 114*a*.

While the description has been made in terms of a puffer-type circuit interrupter in the above embodiment, the present invention can similarly be applied to electrical devices with a puffer cylinder such as a disconnector and a grounding device which is required to have a current switching capability.

As apparent from the above description, the hydraulic operating apparatus for a circuit interrupter is provided with a signal edit and conversion unit which allows the pattern of the speed control of the linear motor to be easily modified from the exterior of the operating mechanism to control the driving of the linear motor, whereby the main hydraulic control valve is driven by the linear motor without the need for an amplifying valve, whereby the pattern of the speed control of the circuit interrupter can be freely varied and set from the exterior of the hydraulic operating mechanism. Therefore, the modification of the speed pattern of the circuit interrupter and the operating mechanism during their development can be very easily made, so that the speed of designing is very high and the most suitable operating patter can be easily determined.

Figure 9:
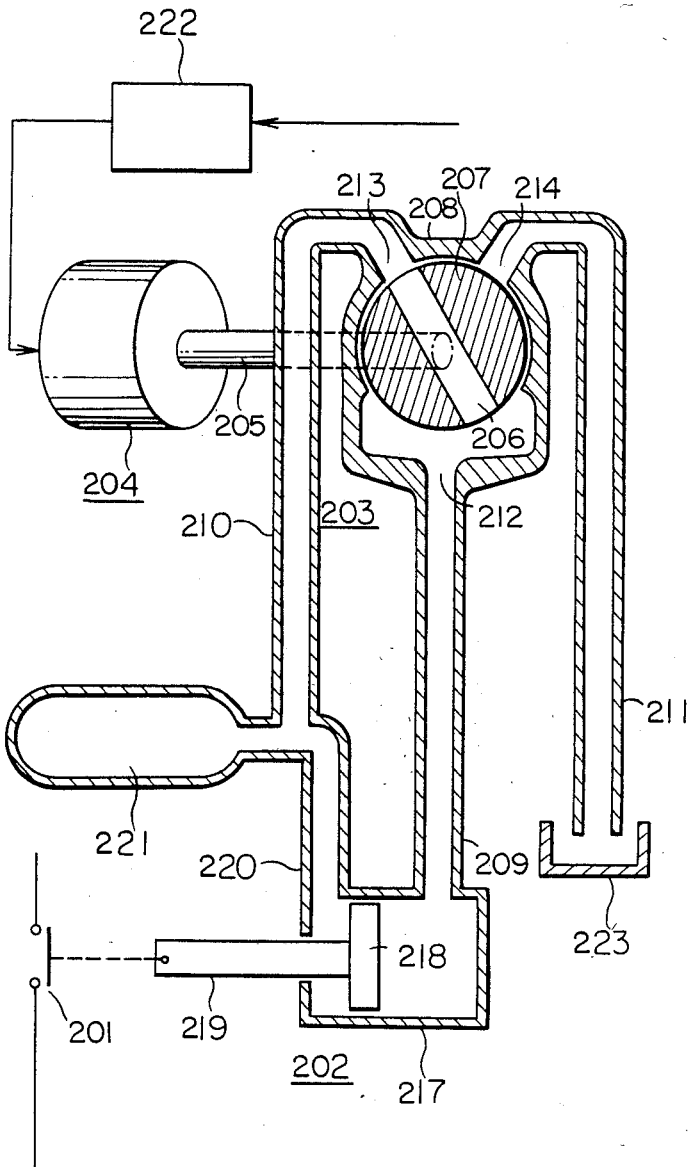
FIG. 9 is a schematic diagram illustrating another embodiment of the hydraulic operating mechanism for a circuit interrupter of the present invention.
Figure 10A:
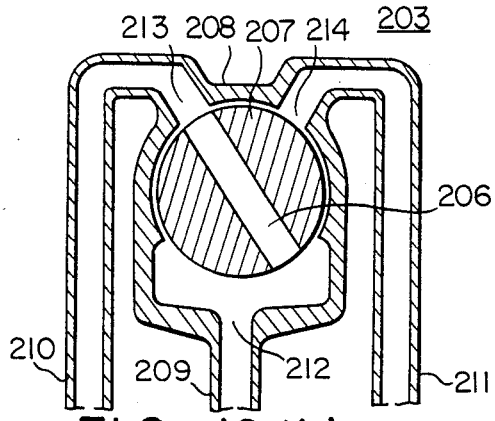
FIG. 10 is an explanatory view illustrating the operation of the main control valve.
Figure 10D:
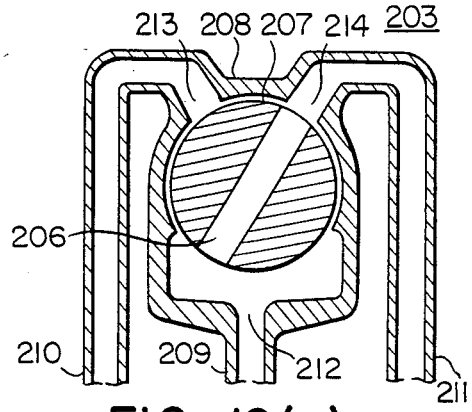
Figure 10B:
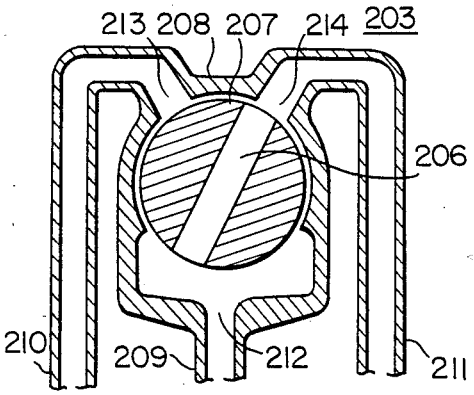
Figure 10E:
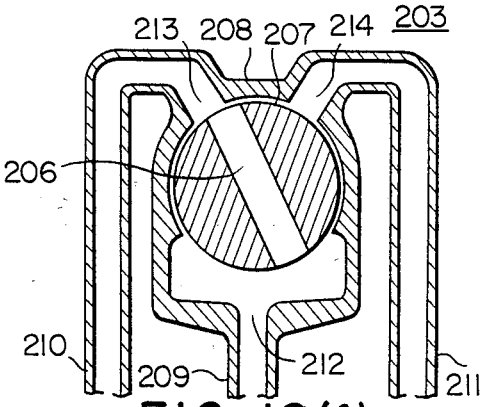
Figure 10C:
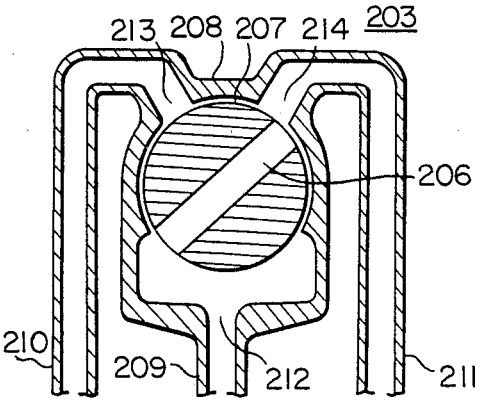
Figure 10F:
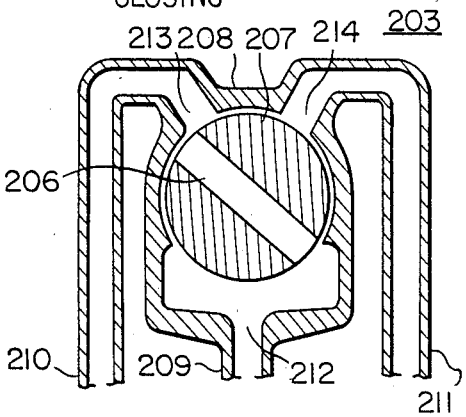

In another embodiment of the present invention shown in FIG. 9, reference numeral 201 designates an interrupting contact, 202 a hydraulic cylinder for closing and opening the contact 201, and 203 a rotary-type main control valve controlled by a servo motor 204. One end of an output shaft 205 of the servo motor 204 is connected to a rotary-type valve 207 which together with valve casing 208 housing the valve 207 constitutes the main control valve 203.

The valve casing 208 has formed therein a port 212 capable of opening toward a communicating bore 206 extending through the rotary valve 207 and which is connected to a conduit 209, a port 213 connected to a hydraulic fluid side conduit 10 connectable to the conduit 209 by the communication bore 206, and a port 214 to which an exhaust fluid side conduit 211 connectable to the conduit 209 by the bore 6 is connected. The hydraulic cylinder 202 comprises a cylinder 217, a piston 218 and a rod 219, and the hydraulic cylinder 217 has connected thereto the conduits 209 and 220 which respectively supply the fluid for contact closing from the piston head side and the fluid for contact opening from the rod side. Low pressure tank 223 for storing the return fluid are also provided. An accumulator 221 normally supplemented by an unillustrated pump always stores a high pressure fluid. A conversion unit 222 is provided for converting a control current signal which excites an unillustrated coil of the servo motor 204 in response to the operating command for the circuit interrupter. The output shaft 205 of the servo motor 204 repeats the movement and the stop to predetermined rotational angular positions at high speed by the energization and deenergization of the coil by the signal current.

When it is desired to close the contact 201 of the circuit interrupter as shown in the figure, the closing operation command supplied to the circuit interrupter is transmitted to the servo motor 204 as a series of drive signal currents through the conversion unit 222. The servo motor repeats a number of movements and stops in accordance with the preset pattern and switches the main control valve 203 into the illustrated position.

While the high pressure fluid is supplied to the rod side of the piston through the conduit 220 upon the closing and opening operations, the above switching of the main control valve 203 causes the conduits 210 and 209 to be brought into communication through the ports 213 and 212 and the head side of the piston is also provided with a high pressure fluid, so that the piston is driven to the left to close the contact 201 of the circuit interrupter.

When an interrupting operation command is provided, a series of drive signal currents are transmitted to the servo motor from the conversion unit 222 to switch the main control valve 203 to the opposite position.

This results in the communication of the conduits 209 and 211 through the ports 212 and 214, causing the pressurized fluid on the cylinder head side to be exhausted, whereby the contact 201 of the circuit interrupter is opened by the pressure differential between the rod side and the head side.

The control of speed will now be described in connection with FIG. 10. Positions (a)-(b)-(c)-(d) and (d)-(e)-(f)-(a) show the change in the angular position of the rotary valve 207 within the main control valve 203 during the shift from the closed state to the open state and from the open state to the closed state, respectively.

These positions of the valve correspond to the reference characters (a)–(f) shown in the travel curve stroke-time curve by a solid line in FIG. 7.

The rotary valve 207 which stays on the left in the figure during the closed state shown by (a) is rotated clockwise in the figure by an interrupter operating command until the rotary valve 207 reaches about the position (b) during the period of time in which the load of the puffer cylinder of the circuit interrupter is large and the interrupting speed must be made at its maximum. As the load of the puffer cylinder decreases the force needed for maintaining the same speed of the rotary valve 207 is decreased, and the rotary valve 207 rotated further clockwise to reduce the cross sectional area of the port 214 increasing the exhaust pressure on the cylinder head side.

At the final stage of the interruption, the rotary valve 7 is further rotated clockwise as shown by (c) to close the port 212, 214 almost completely, thereby increasing the damping effect by the meter-out control to achieve a smooth stop with little shock.

When the spool is to be stopped in the open state after the interruption has been completed, the rotary valve 207 is rotated counterclockwise in the figure to be returned back as shown by (d) to fully maintain the communication between the ports 212 and 214.

When closing, the rotary valve 207 is rotated counterclockwise as shown by (e) to bring the port 213 into communication with the port 212. This causes the hydraulic cylinder 202 to constitute a differential circuit. The speed control is achieved by rotating the rotary valve 207 counterclockwise as in the case of interruption.

At the final stage of the closing operation, the rotary valve 207 is further rotated counterclockwise to almost completely close the port 212, 213 thereby increasing the damping effect by the meter-in control to achieve a smooth stop with little shock.

With such an arrangement, the need for a amplifying valve or a damping dash pot, which are needed when an electromagnetic repulsive control valve is employed, are eliminated, so that the structure is simplified and the operating mechanism becomes more compact.

Figure 11:
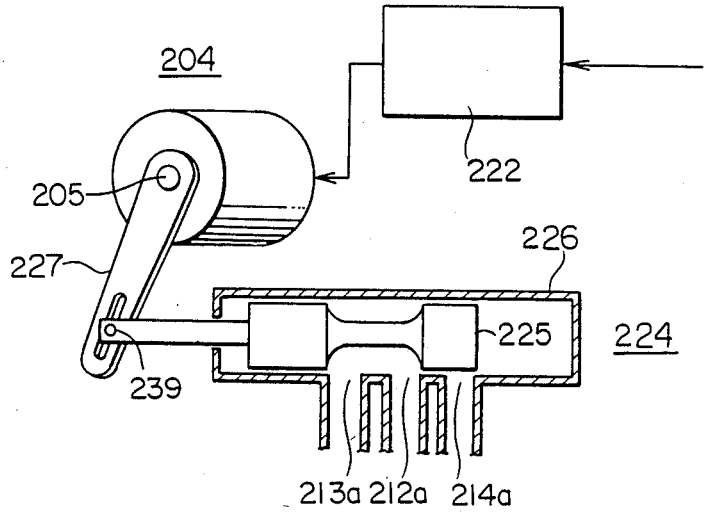
FIG. 11 is a schematic diagram illustrating still another embodiment of the hydraulic operating mechanism of a circuit interrupter of the present invention.

FIG. 11 illustrates another embodiment of the present invention in which a linearly movable type main control valve is used. In the figure, the linear main valve 224 comprises a spool valve 225 having an intermediate reduced diameter portion and a valve casing 226 for slidably housing the spool valve 225 therein.

One end of the lever 227 is secured to the output shaft 205 of the servo motor and the other end is rotatably connected to the spool valve 225 by a pin 239.

The valve casing 226 has formed therein ports 212*a*, 213*a* and 214*a* which correspond in function to those of the ports 212, 213 and 214 formed in the valve casing 208 of the previously described rotary main control valve.

As is apparent from the drawings, as the servo motor 204 rotates in response to an operating command, the linear main control valve slides and controls the speed of movement by decreasing the cross sectional area of the fluid passage between the spool land and the port 13*a* or 214*a*.

According to this embodiment, the main control valve 224 of the hydraulic operating mechanism is arranged to be driven by a servo motor 204 without using an amplifying valve, and the servo motor 204 is arranged to be controlled by the conversion unit 222 for converting and generating a drive signal current of the servo motor 204 in accordance with an operating command, so that the drive speed of the circuit interrupter or the like can be freely controlled in accordance with a preset pattern, resulting in improvements in interrupting performance.

Figure 12:
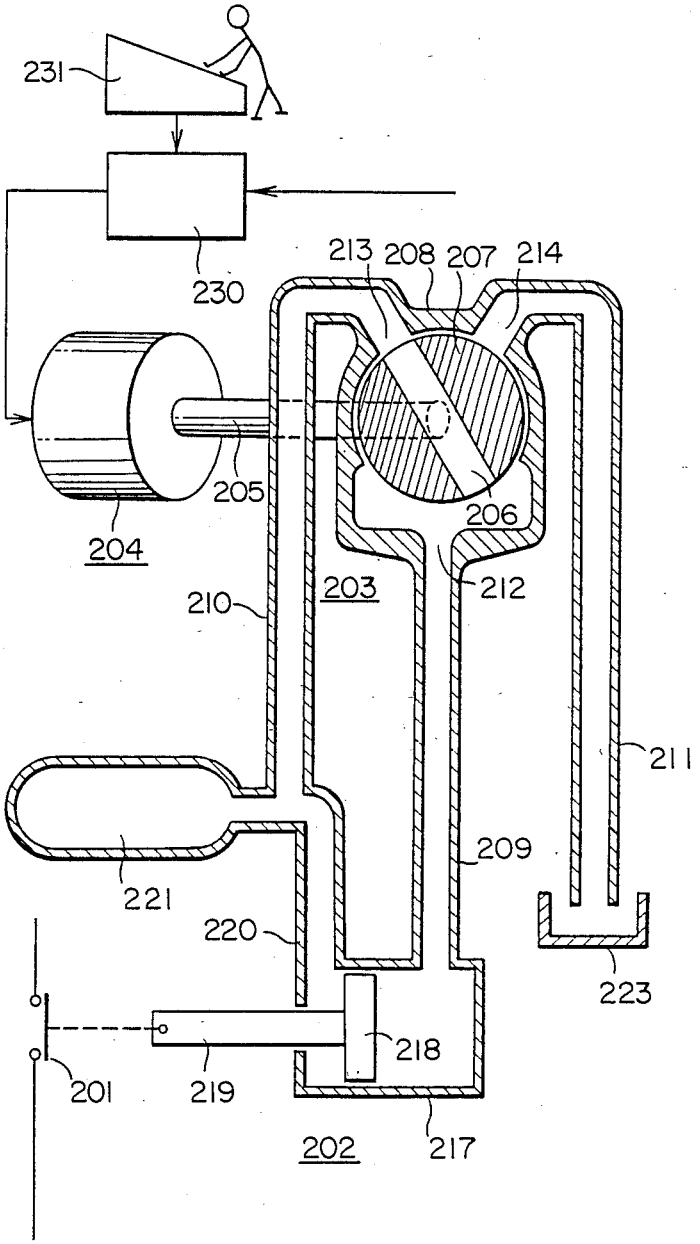

FIG. 12 illustrates still another embodiment of the present invention in which a speed pattern selecting unit 231 similar to the speed pattern selecting unit 131 of the embodiment shown in FIGS. 5 and 8 is additionally connected to the signal conversion unit 222 of the hydraulic operating mechanism previously described and illustrated in conjunction with FIGS. 9 and 10.

Figure 13:
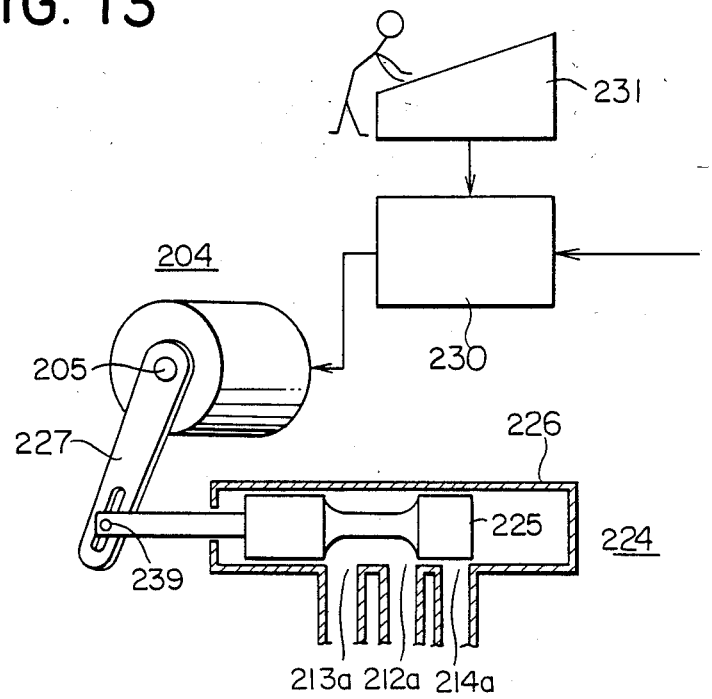
FIGS. 12 to 19 are schematic diagrams illustrating still other embodiments of the hydraulic operating mechanism for a circuit interrupter of the present invention.

The embodiment shown in FIG. 13 is a combination of a speed pattern selecting unit 231 with a hydraulic operating valve system shown in FIG. 11.

Figure 14:
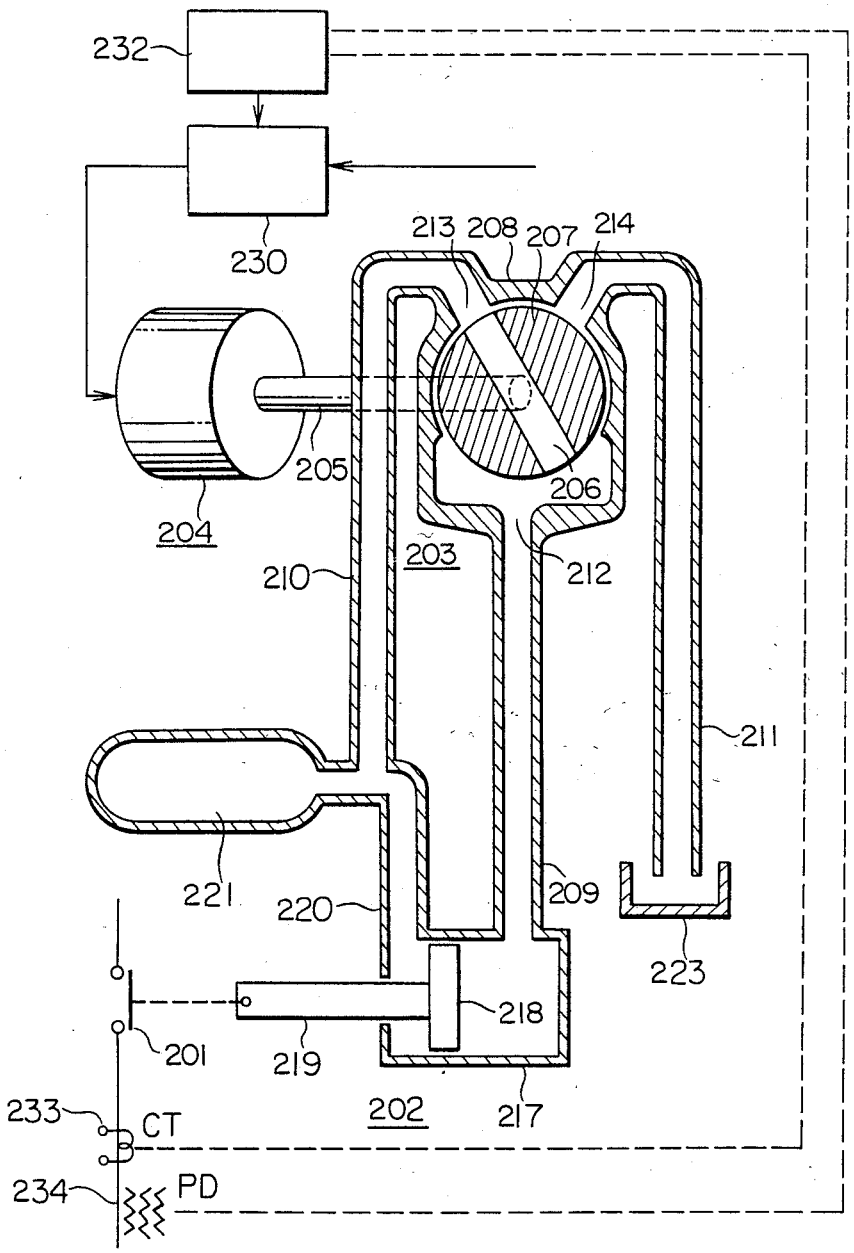

FIG. 14 illustrates another embodiment of the present invention in which the conditions of the power line to be protected such as the voltage and the current conditions are detected and used to determine an optimum speed of the circuit interrupter. In order to achieve this, a current transformer 233 and a potential detector 234 are disposed on the power line for detecting the line conditions such as line voltage and line current of the power line to be protected. These elements 233 and 234 are connected to a speed control pattern determining unit 232 and the detected line conditions are supplied to the speed control pattern determining unit 232 which is connected to the conversion unit 230. The unit 232 supplies a speed control pattern information to the conversion unit 230 and the conversion unit 230 converts and generates a control current signal which excites an unillustrated coil of the servo motor 204 in response to the operating command for the circuit interrupter. The output shaft 205 of the servo motor 204 repeats the movement and the stop to predetermined rotational angular positions at high speed by the energization and deenergization of the coil by the signal current.

According to this embodiment, a servo motor 204 is employed as a drive unit for the main control valve 203 of the hydraulic operating mechanism and the line conditions such as the voltage and the current at the time of interruption is detected on an on-line basis, and is provided with an edit and conversion unit 230 which allows the drive signal current for the servo motor 204 for achieving an optimum speed control of the circuit interrupter in accordance with the detected line conditions to control the driving of the servo motor 204, whereby the main hydraulic control valve is driven at optimum speed without the use of an amplifying valve, the massive stress often exerted on the drive of the circuit interrupter is reduced and the operational reliability of the circuit interrupter is improved.

Figure 15:
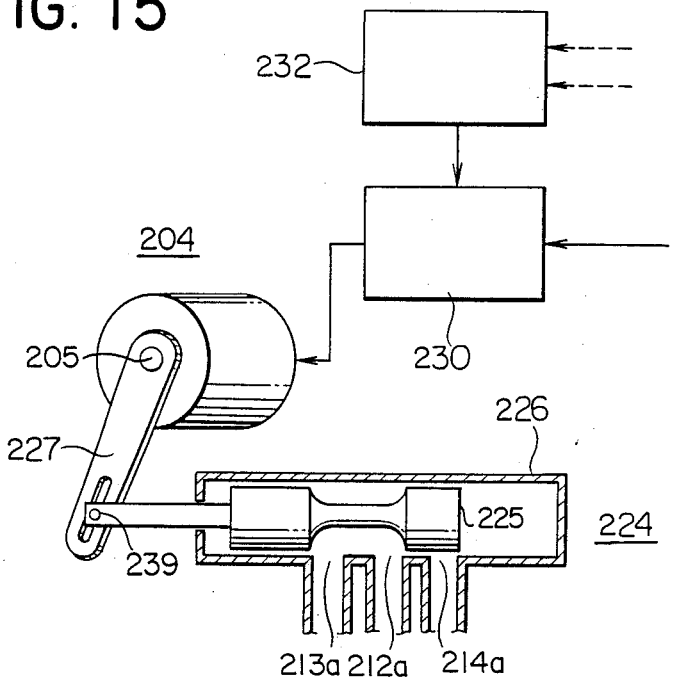

FIG. 15 shows another embodiment in which the same speed control system as that used in the embodiment shown in FIG. 14 is incorporated into the valve mechanism illustrated in FIG. 11.

Figure 17:
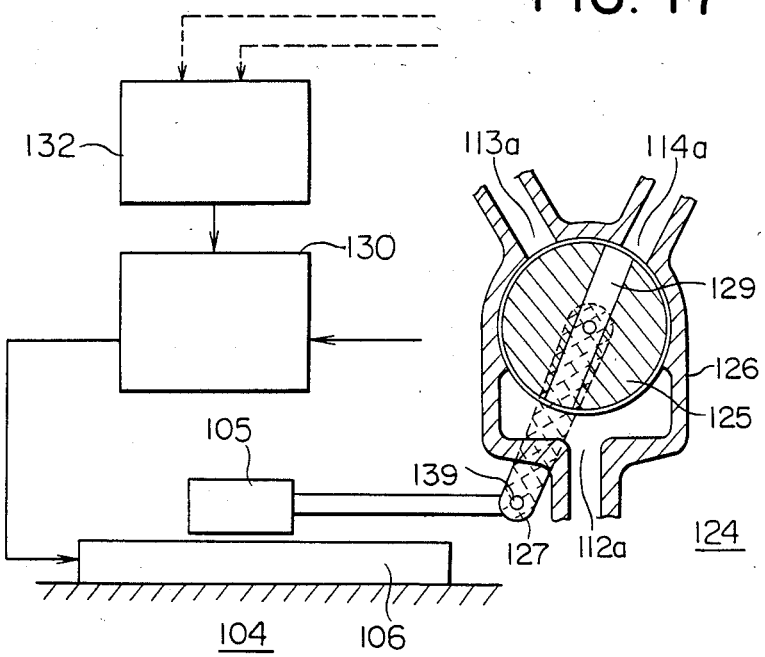
Figure 16:
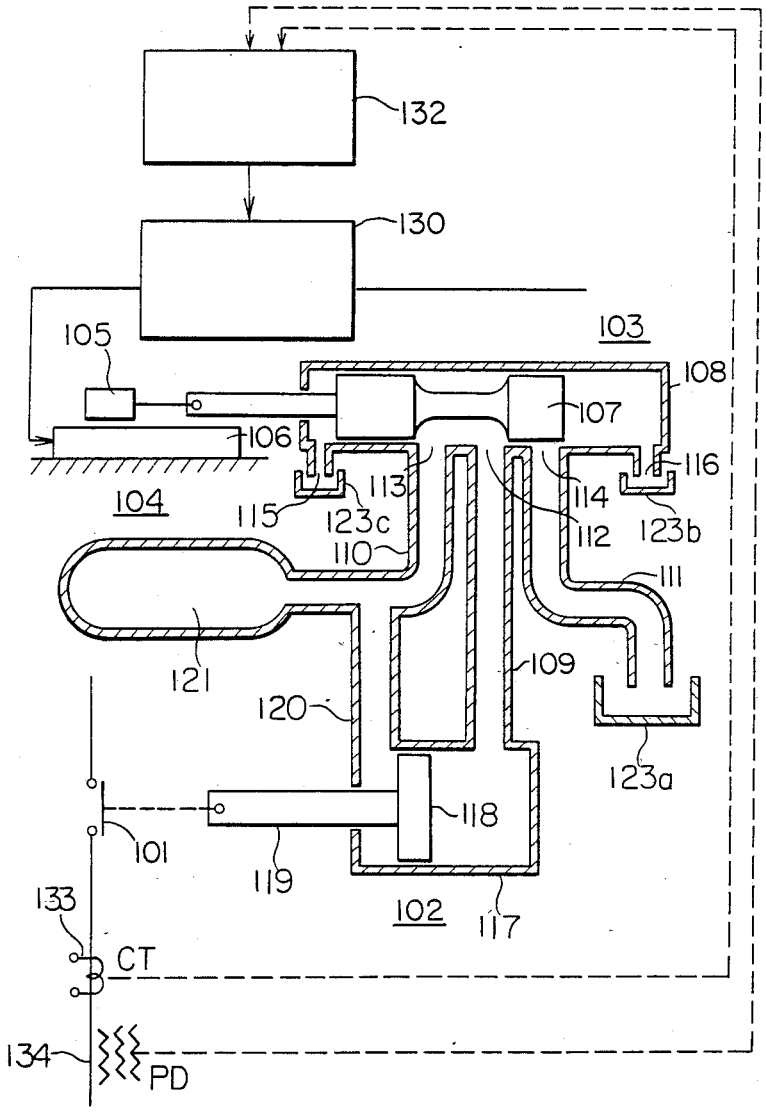

FIG. 16 illustrates still another embodiment of the present invention in which a linear motor 104 is used in place of the servo motor 204 of the embodiment shown in FIG. 15, and the embodiment shown in FIG. 17 also employs a linear motor 104 in place of the servo motor 204 of the arrangement shown in FIG. 14. In other respects, these embodiments shown in FIGS. 16 and 17 are the same as those illustrated in FIGS. 15 and 14, respectively.

Figure 18:
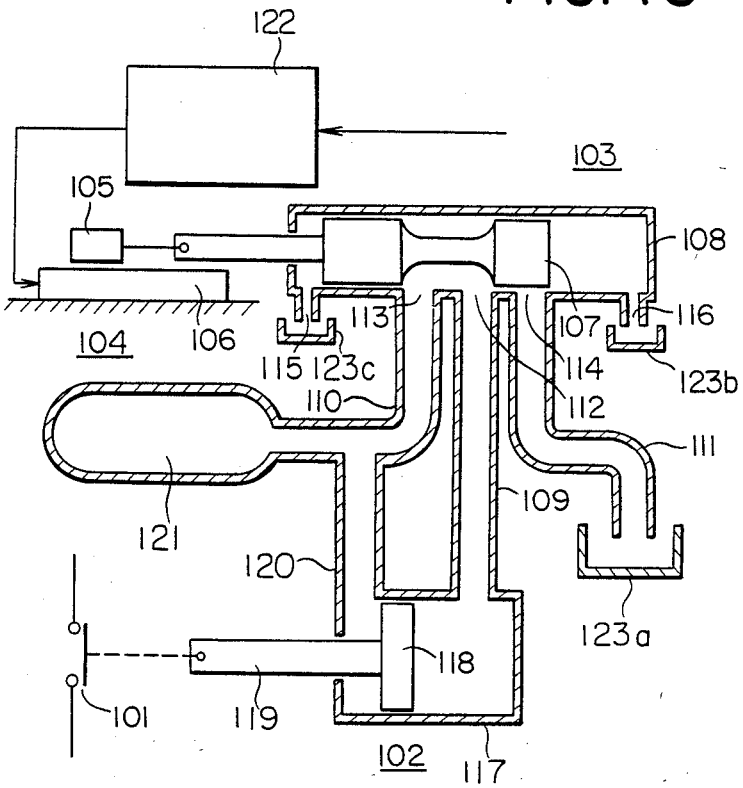
Figure 19:
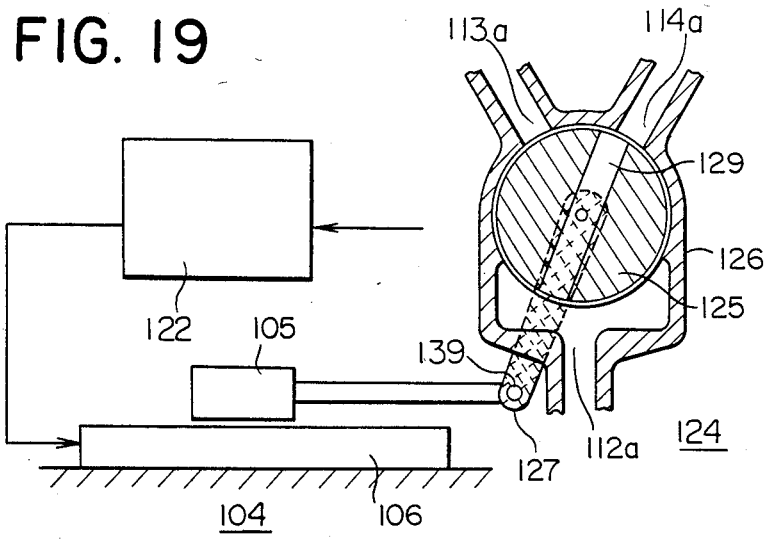

FIGS. 18 and 19 show still other embodiments of the present invention in each of which a linear motor 4 is substituted for the servo motor 204 of the embodiments shown in FIGS. 11 and 9, respectively.

What is claimed is:

1. A hydraulic operating apparatus connected to a circuit interrupter having a contact comprising a hydraulic cylinder driving said contact and hydraulic control valve means for controlling supply of a fluid through fluid passages to said hydraulic cylinder in response to closing and interrupting commands, thereby closing and interrupting said contact, and a position control motor connected to position a valve member of said hydraulic control valve means, said hydraulic operating apparatus having means for converting input information concerning a desired speed control pattern of the interrupter into an electrical signal for driving said motor according to the closing and interrupting commands, the signal provided from said converting means being transmitted to said motor such that the displacement of said motor causes the valve member of said hydraulic control valve means to be positioned to connect the fluid pasages to selectively drive said hydraulic cylinder in different directions, and such that the valve member of said hydraulic control valve means is positioned at an intermediate position different from final stop positions respectively corresponding to an interruption or closed state of the contact to provide a throttle effect in said hydraulic control valve means, thereby controlling the speed of said hydraulic cylinder to provide the desired speed control pattern to the interrupter.

2. A hydraulic operating apparatus as claimed in claim 1 wherein said conversion means comprises first means for generating a desired speed control pattern for the circuit interrupter on the basis of supplied information, means for obtaining information concerning voltage and current of a power line to be protected by the circuit interrupter and for supplying such information to said first means, and second means for converting the speed control pattern into an electrical signal for driving said motor according to the closing and interrupting commands.

3. A hydraulic operating apparatus connected to a circuit interrupter having a contact comprising a hydraulic cylinder driving said contact and hydraulic control valve means for controlling supply of a fluid through fluid passages to said hydraulic cylinder in response to closing and interrupting commands, thereby closing and interrupting said contact, and a position control motor connected to position a valve member of said hydraulic control valve means, conversion means for converting contact closing and opening commands of a desired speed control pattern of the interrupter into an electrical signal for driving said motor, the signal provided from said converting means being transmitted to said motor such that the motion of said motor causes the valve member of said hydraulic control valve means to be positioned to connect the fluid pasages to selectively drive said hydraulic cylinder in different directions, and such that the valve member of said hydraulic control valve means is positioned at an intermediate position different from final stop positions respectively corresponding to an interruption or closed state of the contact to provide a throttle effect in said hydraulic control valve means, thereby controlling the speed of said hydraulic cylinder to provide the desired speed control pattern to the interrupter.

4. A hydraulic control valve apparatus wherein a fluid passage is opened or closed by actuating a valve by a command signal comprising:

a hydraulic valve which can move between an open position, a closed position, a first partially open position, and a second partially open position;

a hydraulic piston which is connected to an electric switch and which can be moved by hydraulic pressure between an open position in which it opens the switch and a closed position in which it closes the switch;

hydraulic piping which is filled with a hydraulic fluid and which connects said hydraulic valve and said hydraulic piston so that the hydraulic fluid acts on said hydraulic piston with a prescribed hydraulic force to respectively open or close said hydraulic piston when said hydraulic valve is in its open or closed position, and so that the hydraulic fluid acts on said hydraulic piston with a lesser hydraulic force to respectively open or close said hydraulic piston when said hydraulic valve is in its first partially open position or its second partially open position;

a motor capable of incremental movement for moving said hydraulic valve among its position; and a controller for controlling the movement of said hydraulic valve by said motor in response to an open or close command signal so as to obtain a prescribed speed pattern for said hydraulic piston.

5. A hydraulic control valve apparatus as claimed in claim 4 wherein said controller includes a converter for converting the open or close command signal into electrical signals capable of controlling the movement of said motor.

6. A hydraulic operating apparatus as claimed in claim 4, wherein said motor comprises a servo motor.

7. A hydraulic operating apparatus as claimed in claim 4 wherein said motor comprises a linear motor.

* * * * *